United States Patent [19]

Brown

[11] Patent Number: 4,991,745

[45] Date of Patent: Feb. 12, 1991

[54] DISPENSING VALVE WITH TRAMPOLINE-LIKE CONSTRUCTION

[75] Inventor: Paul E. Brown, Midland, Mich.

[73] Assignee: Liquid Molding Systems, Inc., Midland, Mich.

[21] Appl. No.: 462,613

[22] Filed: Jan. 9, 1990

Related U.S. Application Data

[63] Continuation-in-part of Ser. No. 343,464, Apr. 25, 1989.

[51] Int. Cl.[5] ..... B05B 11/04

[52] U.S. Cl. ..... 222/212; 222/490; 222/494; 137/493; 137/845

[58] Field of Search ..... 222/490, 491, 494, 212, 222/213; 137/493, 844, 845

[56] References Cited

U.S. PATENT DOCUMENTS

| | | | |
|---|---|---|---|
| 1,607,993 | 11/1926 | Loewy . | |
| 1,748,682 | 2/1930 | Smith . | |
| 1,825,553 | 9/1931 | Smith . | |
| 1,989,145 | 1/1935 | Newby | 221/60 |
| 1,996,156 | 4/1935 | Janssen | 221/60 |
| 2,005,642 | 6/1935 | Thornton | 222/490 |
| 2,094,700 | 10/1937 | Gunn | 222/490 |
| 2,122,299 | 6/1938 | Sloan | 222/490 |
| 2,644,663 | 7/1953 | Klingler | 137/845 |
| 2,679,954 | 6/1954 | Barnes | 222/490 |
| 2,688,979 | 9/1954 | Kendrick | 137/512.15 |
| 2,720,881 | 10/1955 | Jones | 128/261 |
| 2,758,755 | 8/1956 | Schafler | 222/213 |
| 2,802,607 | 8/1957 | Kalmbach, Jr. et al. | 222/490 |
| 2,937,795 | 5/1960 | Ciliberti | 222/490 |
| 2,941,544 | 6/1960 | Peras | 137/525 |
| 2,942,762 | 6/1960 | Fahr | 222/207 |
| 3,111,703 | 11/1963 | Kaufman | 222/490 |
| 3,165,241 | 1/1965 | Curry | 222/490 |
| 3,179,301 | 4/1965 | Lucht | 222/213 |
| 3,669,323 | 6/1972 | Harker et al. | 222/490 |
| 3,674,183 | 7/1972 | Venable et al. | 222/212 |
| 3,685,700 | 8/1972 | Martin | 222/213 |
| 3,726,436 | 4/1973 | Despain et al. | 222/213 |
| 4,036,412 | 7/1977 | Craig | 222/490 |
| 4,109,836 | 8/1978 | Falarde | 222/494 |
| 4,133,457 | 1/1979 | Klassen | 222/212 |
| 4,616,768 | 10/1986 | Flier | 222/92 |
| 4,620,648 | 11/1986 | Schwartzman | 222/490 |
| 4,646,945 | 3/1987 | Steiner et al. | 222/207 |
| 4,660,747 | 4/1987 | Borg et al. | 222/490 |
| 4,699,300 | 10/1987 | Blake | 222/212 |
| 4,728,006 | 3/1988 | Drobish et al. | 222/181 |
| 4,749,108 | 6/1988 | Dornsbusch et al. | 222/212 |

OTHER PUBLICATIONS

"Silastic LSR—A Guide to Product Performance", 1985 Dow Corning Corp.

*Primary Examiner*—Andres Kashnikow
*Assistant Examiner*—Karen B. Merritt
*Attorney, Agent, or Firm*—Price, Heneveld, Cooper, DeWitt & Litton

[57] ABSTRACT

A self-sealing valve is provided for fluid dispensing packages and the like, of the type which are compressed and decompressed to dispense therefrom liquids, pastes, powders and other similar flowable materials. The valve has a marginal groove extending along one face thereof in a closed pattern to define a central area inside the groove, and an outer area outside the groove. Ribs extend between the center and outer areas of the valve to bridge the groove, and selectively support the center valve area in a trampoline-like fashion. A slit extends through the center valve area, and into at least a portion of the groove to form an orifice that shifts between outwardly open, closed, and inwardly open positions in response to compressing and decompressing the container.

37 Claims, 2 Drawing Sheets

DISPENSING VALVE WITH TRAMPOLINE-LIKE CONSTRUCTION

CROSS-REFERENCES TO RELATED APPLICATIONS

The present application is a continuation-in-part of co-pending U.S. patent application Ser. No. 07/343,464 filed Apr. 25, 1989, entitled DISPENSING PACKAGE FOR FLUID PRODUCTS AND THE LIKE, which is hereby incorporated by reference.

BACKGROUND OF THE INVENTION

The present invention relates to product packaging, and in particular to dispensing packages for fluid products, and the like.

Many different types of packages or containers are presently available for storing non-solid products of the type which are capable of flowing, such as fluid or fluidized materials, including liquids, pastes, powders, and the like, which substances are collectively and generically referred to herein as "fluids". Some such packages include a dispenser which permits a selected amount of fluid to be discharged from the package and then reseals to close the package.

Self-sealing dispensing valves have been used in packaging for certain types of products, such as the container disclosed in U.S. Pat. No. 4,728,006 to Drobish et al., which is designed for shampoos, conditioners, and the like. However, such valves can experience some sealing problems, as well as inconsistent dispensing flow rates, particularly when the packages are exposed to significant temperature variations. For instance, in most portions of North America, the ambient temperature varies greatly throughout the year, which results in some associated degree of temperature changes inside even air conditioned buildings, particularly between nighttime and daytime. For packages designed for use in special places, such as a household shower or bath, the temperature in the room can shift quite drastically during use. Dispensing packages used in such environments experience difficulty in maintaining consistent flow and sealing characteristics.

Furthermore, valves constructed from most conventional plastic materials cannot be used in certain types of packages since they either react with or adulterate the product. For instance, in food packaging, care must be taken to avoid valve materials which contain any type of toxins. Furthermore, active ingredients in products can cause the valve to either embrittle or soften, thereby ruining the designed flow rate and/or self-sealing characteristics of the valve.

Another drawback generally associated with prior art dispensing valve is their inability to consistently permit a preselected amount of air to be drawn or sucked back into the container after dispensing, while at the same time, maintaining a tight, secure seal that will prevent leakage even when the container is hung in an inverted orientation. When using containers of the type that have resiliently flexible sidewalls, the lack of sufficient air sucked back through the valve causes the container walls to at least partially collapse, thereby making further dispensing more difficult, and typically preventing, or at least greatly frustrating the user from getting all of the fluid out of the container.

SUMMARY OF THE INVENTION

One aspect of the present invention is a selfsealing valve with a trampoline-like construction that is particularly adapted for fluid dispensing packages and the like of the type which are compressed and decompressed to dispense various fluids therefrom such as liquids, pastes, powders, and other similar flowable materials. The valve has a marginal groove extending along one face thereof in a closed pattern to define a center area inside the groove, and an outer area outside the groove. At least one rib extends between the center and outer areas of the valve to bridge the groove and selectively support the center valve area in a trampoline-like fashion. A slit is provided in the center valve area, and preferably extends into at least a portion of the groove, and forms an orifice that is shifted between outwardly open, closed, and inwardly open positions in response to compressing and decompressing the container.

The principal objects of the present invention are to provide a self-sealing dispensing valve having a unique groove and rib arrangement which selectively supports the slit orifice portions of the valve in a trampoline-like fashion to insure proper suck back of the air into the container after dispensing, while at the same time providing a secure, leak resistant seal. The valve shifts to an outwardly open position upon application of a predetermined threshold pressure, and upon removal of the threshold pressure shifts the orifice from the outwardly open position, through a closed position, into an inwardly open position to draw air back into the container to substantially equalize the pressure therein, and thereby return the orifice to the closed position. In the closed position, the orifice is securely closed, so as to prevent the fluid product from leaking when inverted, or from drying out, loosing flavor, or otherwise changing the product's original characteristics by virtue of exposure to ambient air. The dispensing valve also accurately controls the flow rate of product out of the container, so as to consistently dispense a predetermined amount of product at each use throughout the life of the package.

Preferably, the dispensing valve is constructed from a liquid silicone rubber, which is completely inert, and will not react with or adulterate the fluid product. The opening and closing characteristics of the valve remain substantially unaltered even when the package is exposed to significant temperature fluctuations. The non-stick nature of the liquid silicone rubber valve prevents the valve from fouling, and assists in cleaning excess fluid product from the same. When used in conjunction with containers having semi-rigid, flexible sidewalls, the inwardly open position of the orifice permits entry of sufficient air so that the sidewalls of the container will automatically assume their original shape, and prevents collapsing of the same to facilitate subsequent dispensing and complete emptying of the container. The self-sealing valve is efficient in use, economical to manufacture, capable of a long operating life, and particularly well adapted for the proposed uses. These and other advantages of the invention will be further understood and appreciated by those skilled in the art by reference of the following written specification, claims, and appended drawings.

DETAILED DESCRIPTION OF THE PREFERRED EMBODIMENTS

For purposes of description herein, the terms "upper," "lower," "right," "left," "rear," "front," "vertical," "horizontal," and derivatives thereof shall relate to the invention as oriented in FIGS. 1–4. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 14:
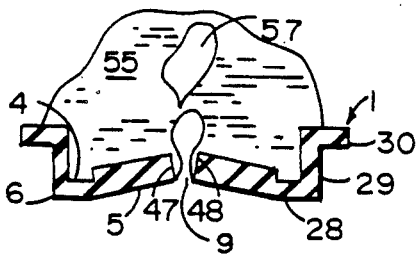
FIG. 14 is an enlarged cross-sectional view of the valve shown in the inwardly open position assumed when the package is in the condition illustrated in FIG. 13.

The reference numeral 1 (FIG. 1) generally designates a self-sealing dispensing valve embodying the present invention. Valve 1 is particularly adapted for use in conjunction with fluid dispensing packages, and the like of the type which are compressed and decompressed to dispense liquids, pastes, powders, and other similar flowable materials or "fluids". One such dispensing package is the illustrated package 10, which includes a container 2, with a removable cap or closure 3. Valve 1 has a marginal groove 4 (FIG. 3) extending along one face thereof in a closed pattern to define a center area 5 inside groove 4, and an outer area 6 outside groove 4. Ribs 7 extend between the center area 5 and outer area 6 of valve 1 to bridge groove 4, and selectively support the center valve area 5 in a fashion somewhat similar to or reminescent of a trampoline. A slit 8 extends through the center valve area 5, and preferably into at least a portion of groove 4 to form an orifice 9 (FIG. 14) that shifts between outwardly open, closed and inwardly open positions (FIGS. 9–14) in response to compressing and decompressing container 2.

Container 2 may assume a wide variety of different shapes, sizes, and constructions to accommodate various fluid products. One particularly attractive application of the present invention relates to the packaging of consumer products such as foodstuffs, school and art supplies, toilet articles, household lubricants, and other similar classes of goods. For example, fluid food items such as cooking oils, salad dressings, catsup, mustard, syrups, and the like can be advantageously packaged in the present invention. School and art supplies, such as paints, pastes, etc., as well as toilet articles such as toothpaste, skin creams and powders, shampoos, conditioners, etc., are also popular items which can be packaged for convenience in the present invention. It is to be understood that the present invention also contemplates use with many other types of consumers products, as well as commercial, industrial, and institutional applications.

In all such cases, container 2 will be shaped, sized, and constructed in accordance with the particular characteristics of the product involved. In the example illustrated in FIGS. 1–2, 9, 11, and 13, container 2 has a cylindrically shaped sidewall 15, a circular bottom 16, and a tapered top portion 17 with a cylindrically shaped neck 18. In this example, container 2 is integrally molded from a suitable plastic material, so as to form a unitary one-piece structure. The interior of neck 18 is hollow to define a discharge opening 19, and sidewall 15 is preferably resiliently deformable and/or manually flexible, so that fluid material within container 2 is forced through the discharge opening 19 of neck 18 by flexing sidewall 15 inwardly. The illustrated container sidewall 15 is sufficiently rigid that upon removal of the dispensing force, it will automatically assume its original shape. The upper portion of container neck 18 includes an annularly shaped recess 20 that defines a marginal lip 21, and a crimpable collar 22 which is upstanding from lip 21 for purposes of attaching valve 1, as discussed below.

It is to be understood that while container 2 employs a flexible sidewall 15 to generate a "threshold pressure" (as discussed below) in the container, other means of pressure generation are also contemplated by the present invention. For example, a plunger or cylinder (not shown) may be mounted in container 2 to pressurize the interior of the container. Alternatively, an outside source of fluid pressure (not shown) may be selectively communicated with the interior of the container 2. In all such cases, it is the application and removal of such pressure at the level of the designated threshold pressure of a particular dispensing package 10 which causes the associated self-sealing valve 1 to automatically open and close.

The self-sealing dispensing valve 1 illustrated in FIGS. 1–14 is generally hat-shaped, and includes a flat, circular top wall 28, a cylindrical side wall 29, and an annularly shaped, radially extending flange 30. The flange 30 of self-sealing valve 1 is resiliently deformable between opposite faces 31 and 32 to facilitate sealingly mounting the same in the neck 18 of container 2 in one of a variety of different manners, as disclosed in the related application noted here-in-above.

Figure 1:
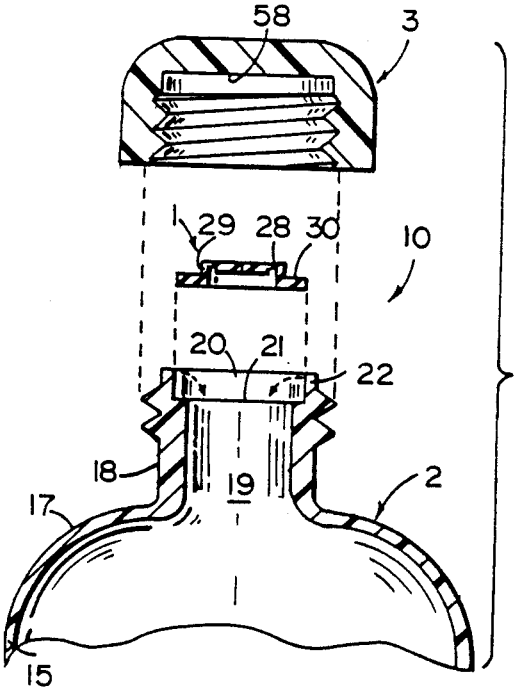
FIG. 1 is an exploded, vertical cross-sectional view of a dispensing package embodying the present invention, including a container, a self-sealing dispensing valve, and a closure
Figure 2:
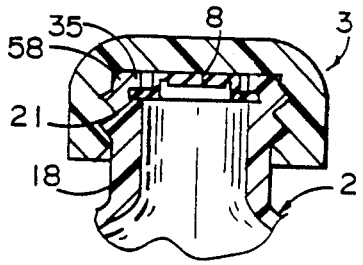
FIG. 2 is a vertical cross-sectional view of the dispensing package illustrated in FIG. 1, shown in a fully assembled condition, and with the closure attached for storage.
Figure 3:
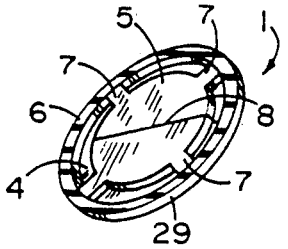
FIG. 3 is a perspective view of the valve, with a flange portion thereof broken away.
Figure 4:
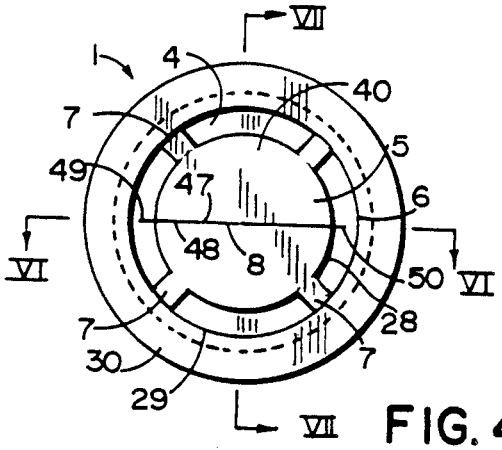
FIG. 4 is an enlarged bottom plan view of the valve.

As best shown in FIGS. 1–2, the illustrated valve 1 is mounted in container 2 by positioning valve 1 on the lip 21 of container 2. The collar 22 of container neck 18 is then inelastically deformed in a radially inwardly direction to envelope the flange 30 of self-sealing valve 1, as shown in FIG. 2. That portion of collar 22 which is deformed inwardly defines a rim 35 which is forced downwardly toward container lip 21, thereby compressing the flange 30 of valve 1 between opposing surfaces 31 and 32, and forming a leak resistant seal therebetween.

In the illustrated embodiment of the present invention, container collar 22 is preferably constructed from a thermoplastic material. The crimping operation comprises heating the outer portion of collar 22 to apliable state, inelastically deforming rim 35 inwardly over valve flange 30, pressing rim 35 against valve flange 30 and container lip 21 to compress valve flange 30 therebetween, and cooling rim 35 while maintaining flange compression until rim 35 returns to a state of sufficient rigidity that the compression of valve flange 30 is permanently maintained. The crimping action of rim 35 serves to securely mount valve 1 in container 2, while at the same time forming a leak resistant seal by virtue of compressing the faces 31 and 32 of valve flange 30.

It is to be understood that valve 1 can be mounted in container 2 in a wide variety of other manners, as contemplated by the above-noted, related application, as well as would otherwise be appreciated by those having ordinary skill in the art.

The illustrated valve 1 is integrally molded from an inert, non-toxic, plastic material, so as to provide a unitary one-piece construction. In the preferred embodiments of the present invention, valve 1 is molded from a liquid silicone rubber, such as the material marketed under the trademark "Silastic" by Dow Corning Corporation, the characteristics of which are disclosed in the cited brochure entitled "Silastic LSR - A Guide to Product Performance". With liquid silicone rubber, all of the walls of valve 1 are flexible, and their physical and/or chemical characteristics do not alter substantially in response to ambient changes, such as temperature fluctuations, or exposure to active ingredients in products. Hence, the designed material flow rate and sealing pressure of any particular valve 1 will remain relatively constant. Furthermore, since liquid silicone rubber is inert and non-toxic, valve 1 is particularly well adapted for use in conjunction with the packaging and dispensing of food products, including cooking oil, catsup, mustard, syrups, and other edible products that are sold in fluid form. As a result of the inert nature of liquid silicone rubber, valve 1 will not react with product in container 2 so as to adulterate or otherwise contaminate the product. Since valve 1 is constructed from liquid silicone rubber, it can be easily deformed without taking a set, and can be flexed repeatedly without embrittling or cracking.

In the illustrated example, valve 1 has a unique trampoline-like construction which permits air to be sucked back into the container 2 after dispensing, yet maintains a secure type seal when closed. As best illustrated in FIGS. 3–8, the top wall 28 of valve 1 has a substantially flat or planar outerface 40 while the innerface 41 has a unique, trampoline-like configuration. The trampoline-like valve configuration is defined by the groove 4 which extends along the innerface 41 of valve top wall 28 in a closed pattern to define the center and outer areas 5 and 6 respectively of valve 1. In the illustrated example, groove 4 has an annular plan configuration, as defined by circular sidewalls 42 and 43, and top wall 44. The center valve area 5 is a flat disc-shaped pad, with ribs 7 extending radially therefrom to bridge groove 4. In one working embodiment of the present invention, the width of groove 4, as defined by the distance between sidewalls 42 and 43, is in the range of 1 to 3 times the thickness of center valve area 5. In this same example, the depth of groove 4, as defined by the distance between outer valve face 40 and top groove wall 44, is in the range of $\frac{1}{4}$–$\frac{3}{4}$ of the thickness of center valve area 5.

In the illustrated example, slit 8 extends substantially continuously along center valve area 5 at a medial portion thereof. Slit 8 is preferably formed through top valve wall 28 by simply slicing top wall 28 or otherwise severing the material of top wall 28 without removing any material therefrom, such that the mating slit edges 47 and 48 closely abut one another when valve 1 is in the closed position. In the illustrated example, slit 8 is straight or linear, with the opposite ends 49 and 50 of slit 8 positioned in the middle of groove 4, at diametrically opposite portions thereof. The extension of slit 8 into the opposite areas of groove 4 contributes to the unique flexing action achieved by valve 1.

Each of the illustrated valves 1 (FIGS. 3–8) includes four ribs 7 which extend between the center and outer areas 5 and 6 of valve 1, and are spaced equadistantly about groove 4. The illustrated ribs 7 are oriented in a non-aligned, yet symmetrical fashion with respect to slit 8, such that slit 8 bisects center valve area 5 at an angle of approximately 45 degrees from the next adjacent pair of ribs 7. In the illustrated example, ribs 7 each have a generally square plan configuration, with a thickness substantially equal to the center valve area 5. The additional thickness of ribs 7 selectively stiffens the center valve area 5 in a trampoline-like manner to facilitate shifting valve orifice 9 between the outwardly open, closed and inwardly open positions. In the example illustrated in FIGS. 1–13, the outer sidewall 43 of groove 4 is positioned coincident with the interior surface of valve sidewall 29, which positioning also contributes to the selective opening and closing of valve orifice 9.

From an operational viewpoint, ribs 7 selectively resiliently support the center pad area 5 of valve 1, and contribute to controlling the flexure of the same, as well as associated orifice 9, when container 2 is shifted between the compressed and decompressed conditions. Ribs 7 also assist in the molding of valve 1 by providing air gates or vents within the mold which insure complete filling of the mold cavity.

Figure 10:
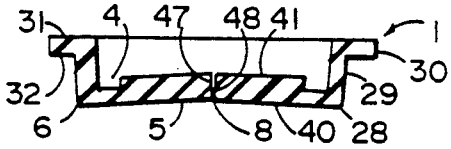
FIG. 10 is an enlarged cross-sectional view of the valve shown in the closed position assumed when the package is in the condition illustrated in FIG. 9.
Figure 12:
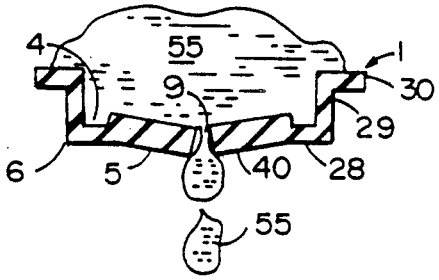
FIG. 12 is an enlarged cross-sectional view of the valve shown in the outwardly open position, assumed when the package is in the condition illustrated in FIG. 11.
Figure 11:
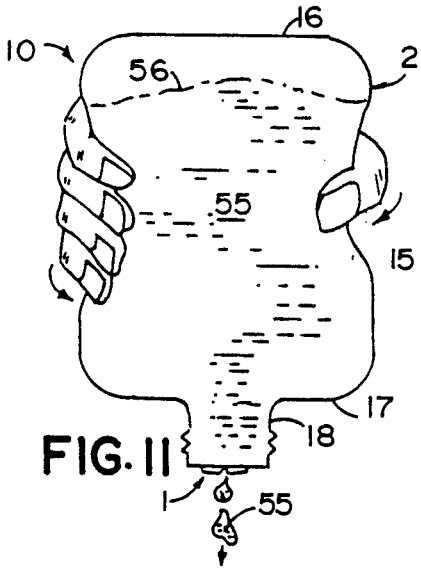
FIG. 11 is a partially diagrammatic view of the dispensing package shown in FIG. 9, but with the sidewalls flexed inwardly to compress the package and dispense fluid product through the valve shifted into an outwardly open

The size and shape of valve orifice 9, in conjunction with the thickness and configuration of the adjacent valve walls, may be varied in accordance with the viscosity, and other physical characteristics of the product being dispensed, as well as the desired flow rate, flow pattern, threshold pressure, sealing pressure, and designed orientation of the container. The term "threshold pressure" as used herein refers to that pressure in or on the fluid product which will cause the valve orifice 9 to shift from the closed position (FIGS. 9 & 10) to the outwardly open position (FIGS. 11 & 12). In the case of the illustrated container 2, which has flexible sidewall 15, the force necessary to achieve the threshold pressure will depend upon the shape, size, and rigidity of the container 2.

All such factors are preferably balanced and adjusted to achieve the correct dispensing characteristics for orifice 9. For example, in consumer product applications, such as toothpaste and the like, it is important to obtain the desired flow rate and pattern, without requiring that extensive pressure be applied to the container 2, and without sacrificing the self-sealing closing action of the valve 1.

In those applications illustrated in FIGS. 9–14, container 2 is oriented downwardly or inverted such that valve 1 is subject to a constant hydraulic head, and positive valve closure is essential to prevent leakage. In such applications, valve orifice 9 is configured such that the designed threshold pressure is greater than the maximum hydraulic head pressure of the fluid product in the container 2 when container 2 is inverted with orifice 9 oriented downwardly.

Figure 9:
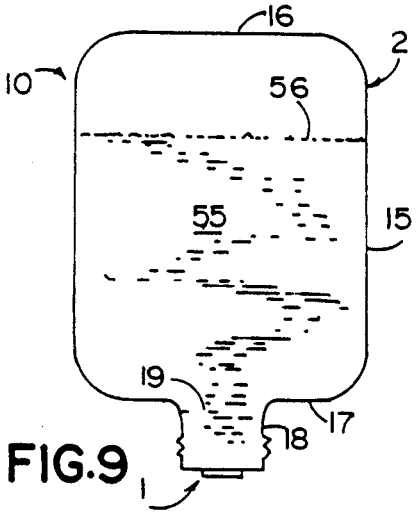
FIG. 9 is a partially diagrammatic view of the dispensing package, shown in an inverted condition with the valve orifice in a closed position.

With container 2 oriented in the inverted orientation illustrated in FIGS. 9–13, valve 1 operates in the following manner. When container 2 is fully decompressed or unpressurized, as illustrated in FIGS. 9 and 10, orifice 9 is closed, and the top wall 28 of valve 1 assumes a generally planar or flat orientation, as shown in FIGS. 1–8. If container 2 retains a slight vacuum, as may sometimes be experienced, particularly in dispensing viscous liquids, the top wall 28 of valve 1 may assume a slightly convex orientation, as shown in FIGS. 9 & 10. Ribs 7 serve to selectively stiffen the center valve area 5, and retain orifice 9 securely closed against the hydraulic pressure generated by the fluid product 55 in container 2.

Figure 5:
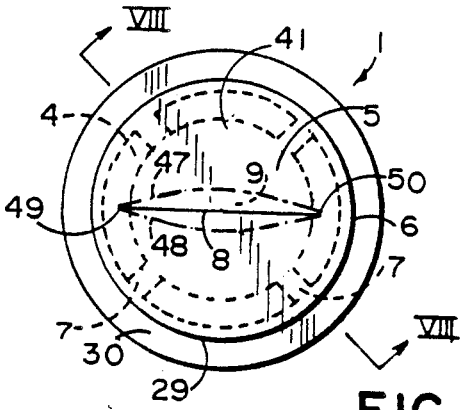
FIG. 5 is an enlarged top plan view of the valve.
Figure 6:
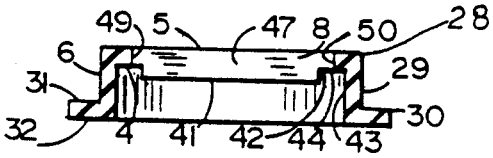
FIG. 6 is a cross-sectional view of the valve, taken along the line VI—VI of FIG. 4.
Figure 8:
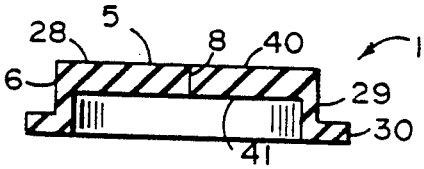
FIG. 8 is a cross-sectional view of the valve, taken along the line VIII—VIII of FIG. 5.
Figure 7:
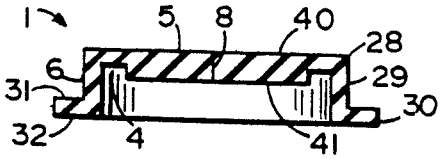
FIG. 7 is a cross-sectional view of the valve, taken along the line VII—VII of FIG. 4.

To dispense product 55 from container 1, the user simply flexes the opposite sidewalls 15 of container 2 inwardly in the manner illustrated in FIG. 10. This flexing action compresses the air trapped above the free surface 56 of fluid product 55 and forces the fluid product 55 out through the orifice 9, which is thereby simultaneously shifted into the outwardly open position illustrated in FIG. 12. When orifice 9 is in the outwardly open position, the center valve area 5 bulges slightly outwardly in an arcuate manner, and the mating edges 47 and 48 of orifice 9 are separated into a double-convex configuration; as illustrated in FIG. 5, and permit fluid product 55 to flow therebetween. Valve groove 4 permits each half of the center valve area 5 to flex from the thinned area of top wall 28 above groove 4 to achieve the desired flow rate and pattern.

Figure 13:
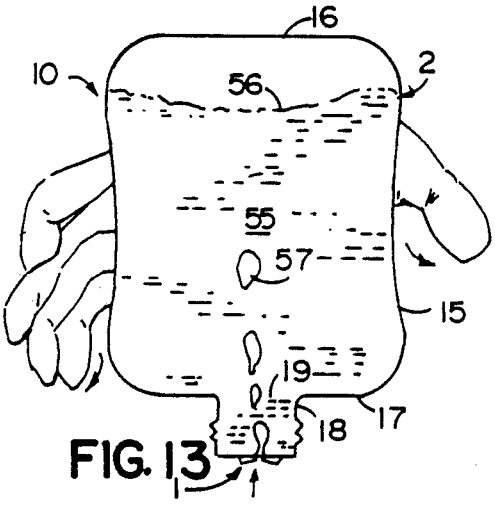
FIG. 13 is a partially diagrammatic view of the dispensing package illustrated in FIGS. 9 and 11, but with the dispensing pressure released, so that the sidewalls return to their original position, and thereby shift the valve into the inwardly open position to draw air back into the container.

To cease dispensing, the user simply removes the force or pressure applied to the sidewall 15 of container 2 in the manner illustrated in FIG. 13, such that the resiliency of the sidewall 15 tends to return them to their original shape. When the force on container 2 is thusly removed, the air above the free surface 56 of fluid product 55 is decompressed to a level below atmospheric, thereby shifting the valve orifice 9 from the outwardly open position illustrated in FIGS. 11 & 12 through the closed position, into the inwardly open position illustrated in FIGS. 13 & 14. The mating edges 47 and 48 of orifice 9 are again drawn into a double-convex configuration, somewhat similar to the outwardly open position shown in FIG. 5 and the center valve area 5 bulges slightly inwardly in an arcuate manner. Air 57 (FIG. 13) is then drawn through orifice 9 into container 2 to substantially equalize the pressure within container 2, and thereby return orifice 9 to the closed position illustrated in FIGS. 9 & 10. The groove 4 and ribs 7 on the innerface 41 of valve 1 permit sufficient inward flexure of the two halves of center valve area 5 to draw air back into the container 2, yet securely reseal orifice 9 as the pressure within container 2 reaches equality with ambient pressure.

To facilitate storage and transport, closure 3 has a threaded interior, and is attached to the threaded neck portion of container 2. As best illustrated in FIG. 2, closure 3 is configured so that its interior surface 58 is substantially flush with the outer face 40 of valve 1 when fully secured, thereby preventing orifice 9 from being shifted into the outwardly open position.

Figure 15:
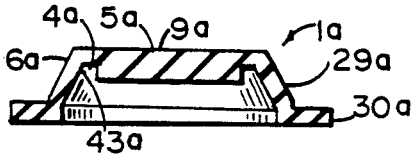
FIG. 15 is a lateral cross-sectional view of a second embodiment of the valve.

The reference numeral **1*a* (FIG. 15) designates another embodiment of the present self-sealing valve which has a frustroconically shaped sidewall. Since self-sealing valve 1*a* is similar to the previously described self-sealing valve 1, similar parts appearing in FIGS. 1–14 and FIG. 15** respectively are represented by the same, corresponding reference numeral, except for the suffix "*a*" and the numerals of the latter. In self-sealing valve **1*a*, the sidewall 29*a* has a frustroconical side elevational configuration, in contrast to the cylindrical configuration of valve 1. The interior surface 43*a* of groove 4*a* is similarly tapered, and coincidence with the interior surface of sidewall 29*a*. As a consequence of the frustroconical shape of sidewall 29*a*, the outside diameter of center valve area 5*a* is substantially smaller than the inside diameter of valve flange 30*a*. The tapered shape of interior valve surface 43*a* tends to focus or direct the pressure within the associated container toward the orifice 9*a***.

Figure 16:
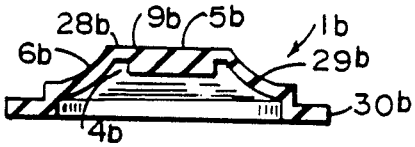
FIG. 16 is a lateral cross-sectional view of a third embodiment of the valve.

The reference numeral **1*b* (FIG. 16) generally designates yet another embodiment of the present self-sealing valve which has an arcuately shaped sidewall. Since self-sealing valve 1*b* is similar to the previously described self-sealing valves 1 and 1*a*, similar parts appearing in FIGS. 1–14 and 16** respectively are represented by the same corresponding reference numeral, except for the suffix "*b*" in the numerals of the latter.

In self-sealing valve **1*b*, the sidewall 29*b* has an upwardly curved side elevational configuration in contrast to the cylindrical configuration of valve 1. The interior surface 43*b* of groove 4*b* is similarly curved, and coincidence with the interior surface of sidewall 29*b*. As a consequence of the upwardly arcuate shape of sidewall 29*b*, the outside diameter of center valve area 5*b* is substantially smaller than the inside diameter of valve flange 30*b*. The arcuately tapered shape of interior valve surface 43*b* also tends to focus or direct the pressure within the associated container toward the orifice 9*b***.

Dispensing package 10 is adapted for a wide variety of different types of fluid products including liquids, pastes, powders, and the like. The unique groove 4 and rib 7 construction of self-sealing valve 1 provides a trampoline-like construction that insures both proper suck back of air into the container after dispensing, as well as secure sealing even when the container is oriented with the orifice 9 facing downwardly. The specific flow rate and sealing pressure desired for any particular dispensing package 10 can be easily adjusted in accordance with the viscosity and other physical characteristics of the fluid product being dispensed. The preferred liquid silicone rubber material of self-sealing valve 1 provides accurate an reliable dispensing of the product, without reacting with or adulterating the product itself.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A dispensing package for fluid materials and the like, comprising:

a container shaped to retain a preselected fluid product therein, and including a wall having a discharge opening, and a resiliently flexible portion for manually shifting said container between a compressed condition and a decompressed condition to selectively move the fluid product through the discharge opening of said container;

a self-sealing dispensing valve connected with said container, communicating with the discharge opening thereof, and including:

a valve wall having a marginal groove extending along one face thereof in a closed pattern to define a center valve area inside said groove, and an outer valve area outside said groove;

at least one rib extending between said center valve area and said outer valve area to bridge said groove and selectively stiffen said valve;

a slit extending through said valve wall to define an orifice that shifts between outwardly open, closed, and inwardly open positions in response to shifting the flexible wall portion of said container; said slit extending substantially continuously along said center valve area, and into at least a portion of said groove, whereby shifting the flexible wall portion of said container from the decompressed condition to the compressed condition shifts said orifice into the outwardly open position, and forces the fluid product therethrough to dispense the same from said container, and shifting the flexible wall portion of said container from the compressed condition to the decompressed condition shifts said orifice from the outwardly open position, through the closed position, into the inwardly open position, and draws air therethrough to substantially equalize the pressure within said container, and thereby return said orifice to the closed position.

2. A dispensing package as set forth in claim 1, wherein:

said valve is constructed such that said orifice will shift from the closed position to the outwardly open position only upon the application of a preselected force on the flexible portion of said container to create an associated predetermined threshold pressure within said container.

3. A dispensing package as set forth in claim 2, wherein:

said valve is configured such that said predetermined threshold pressure is greater than the maximum hydraulic head pressure of the fluid product in said container when said discharge opening is oriented downwardly.

4. A dispensing package as set forth in claim 3, wherein:

said valve includes a pair of said ribs positioned mutually in-line at diametrically opposite portions of said valve wall in a non-aligned relationship with said slit to selectively support said center valve area in a trampoline-like fashion, and ensure complete and timely closure of said orifice.

5. A dispensing package as set forth in claim 4, wherein:

said slit has opposite ends thereof positioned within said groove to control the opening and closing of said wherein:

6. A dispensing package as set forth in claim 5, wherein:

said slit has a linear shape, and is positioned centrally within said center valve area.

7. A dispensing package as set forth in claim 6, wherein:

said container has a molded, one-piece construction with resiliently flexible sidewalls defining the flexible portion of said container; and said valve is constructed such that said orifice permits entry of sufficient air while in the inwardly open position to prevent substantial collapsing of said container sidewalls.

8. A dispensing package as set forth in claim 7, wherein:

said container sidewalls are sufficiently semi-rigid that upon release of said preselected force, said sidewalls will automatically assume their original shape.

9. A dispensing package as set forth in claim 8, wherein:

said groove has a circular plan configuration, and said ribs are oriented radially therewith.

10. A dispensing package as set forth in claim 9, wherein:

said valve includes a flange shaped for connection with said container, and a closed sidewall upstanding from said flange, with an outer portion at which said valve wall is disposed.

11. A dispensing package as set forth in claim 10, wherein:

said valve wall generally comprises a flat top wall with a circular plan shape;

said valve sidewall has a cylindrical shape; and said groove is disposed in said valve top wall at a position adjacent to the sidewall of said valve.

12. A dispensing package as set forth in claim 11, wherein:

said valve includes a second pair of said ribs positioned mutually in-line, and spaced equidistantly from said first-named rib pair; and said slit is positioned symetrically in between one of said first and second-named rib pairs.

13. A dispensing package as set forth in claim 12, wherein:

said valve is constructed from a molded liquid silicone rubber.

14. A dispensing package as set forth in claim 13, wherein:

said groove and said ribs are positioned on an interior face of said valve top wall.

15. A dispensing package as set forth in claim 14, wherein:

said valve sidewall has a cylindrically shaped interior surface; and said groove has an annular shape, with an outside diameter thereof aligned with the interior surface of said valve sidewall.

16. A dispensing package as set forth in claim 15, wherein:

said ribs each have a substantially square top plan configuration.

17. A dispensing package as set forth in claim 16, wherein:

said groove has a depth greater than one fourth of the thickness of said valve center area.

18. A dispensing package as set forth in claim 17, wherein:

said valve flange is resiliently deformable between opposite faces thereof; and including a retainer ring associated with said container adjacent the discharge opening thereof, and including a crimpable collar which is inelastically deformed about the flange of said valve to form a rim which abuttingly engages the other face of said dispensing valve flange and compresses said dispensing valve flange between said container and the rim of said retainer ring to securely mount said dispensing valve on said container, and simultaneously form a leak resistant seal therebetween.

19. A dispensing package as set forth in claim 18, wherein:

said retainer ring is fixedly connected with said container.

20. A dispensing package as set forth in claim 19, wherein:

said retainer ring is formed integrally and in one piece with said container.

21. A dispensing package as set forth in claim 20, wherein:

said container is constructed from a thermosetting plastic, whereby said collar is crimped about said dispensing valve by heat setting.

22. A dispensing package as set forth in claim 1, wherein:

said valve includes a pair of said ribs positioned mutually in-line at diametrically opposite portions of said valve wall in a non-aligned relationship with said slit to selectively stiffen said valve, and ensure complete and timely closure of said orifice.

23. A dispensing package as set forth in claim 1, wherein:

said slit has opposite ends thereof positioned within said groove to control the opening and closing of said orifice.

24. A dispensing package as set forth in claim 1, wherein:

said slit has a linear shape, and is positioned centrally within said center valve area.

25. A dispensing package as set forth in claim 1, wherein:

said container has a molded, one-piece construction with resiliently flexible sidewalls defining the flexible portion of said container; and said valve is constructed such that said orifice permits entry of sufficient air while in the inwardly open position to prevent substantial collapsing of said container sidewalls.

26. A dispensing package as set forth in claim 1, wherein:

said groove has a circular plan configuration, and said rib is oriented radially therewith.

27. A dispensing package as set forth in claim 1, wherein:

said valve includes a flange shaped for connection with said container, and a closed sidewall upstanding from said flange, with an outer portion at which said valve wall is disposed.

28. A dispensing package as set forth in claim 27, wherein:

said valve wall generally comprises a planar top wall with a circular plan shape;

said valve sidewall has a cylindrical shape; and said groove is disposed in said valve top wall at a position adjacent to the sidewall of said valve.

29. A dispensing package as set forth in claim 1, wherein:

said valve includes two pairs of said ribs spaced equidistantly from one another to selectively support said valve center area in a trampoline-like fashion; and said slit is positioned symetrically in between two of said ribs.

30. A dispensing package as set forth in claim 1, wherein:

said valve is constructed from a molded liquid silicone rubber.

31. A dispensing package as set forth in claim 1, wherein:

said groove and said rib are positioned on an interior face of said valve top wall.

32. A dispensing package for fluid materials and the like, comprising:

a container shaped to retain a preselected fluid product therein, and including a discharge opening, and dispensing means for shifting said container between a compressed condition and a decompressed condition to selectively move the fluid product through the discharge opening of said container;

a self-sealing dispensing valve connected with said container, communicating with the discharge opening thereof, and including:

a valve wall having a marginal groove extending along one face thereof in a closed pattern to define a center valve area inside said groove, and an outer valve area outside said groove;

a slit extending through said valve wall to define an orifice that shifts between outwardly open, closed, and inwardly open positions in response to shifting said dispensing means said slit extending substantially continuously along at least a portion of said center valve area, whereby shifting said dispensing means from the decompressed condition to the compressed condition shifts said orifice into the outwardly open position, and forces the fluid product therethrough to dispense the same from said container, and shifting said dispensing means from the compressed condition to the decompressed condition shifts said orifice from the outwardly open position, through the closed position, and into the inwardly open position, and draws air therethrough to equalize the pressure within said container, and thereby return said orifice to the closed position.

33. A self-sealing valve for dispensing packages and the like, of the type having a container which can be shifted between a compressed condition and a decompressed condition to selectively move fluid product through a discharge opening in the container; said valve comprising:

a valve wall having a marginal groove extending along one face thereof in a closed pattern to define a center valve area inside said groove, and an outer valve area outside said groove;

at least one rib extending between said center valve area and said outer valve area to bridge said groove and selectively stiffen said valve;

a slit extending through said valve wall to define an orifice that shifts between outwardly open, closed, and inwardly open positions in response to shifting the container; said slit extending substantially continuously along said center valve area, and into at least a portion of said groove, whereby shifting the container means from the decompressed condition to the compressed condition shifts said orifice into the outwardly open position, and forces the fluid product therethrough to dispense the same from the container, and shifting the container from the compressed condition to the decompressed condition shifts said orifice from the outwardly open position, through the closed position, and into the inwardly open position, and draws air therethrough to equalize the pressure within the container, and thereby return said orifice to the closed position.

34. A self-sealing valve as set forth in claim 33, including:

a pair of said ribs positioned mutually in-line at diametrically opposite portions of said valve wall in a non-aligned relationship with said slit to selectively stiffen said center valve area in a trampoline-like fashion, and ensure complete and timely closure of said orifice.

35. A self-sealing valve as set forth in claim 34, wherein:

said valve is constructed such that said orifice will shift from the closed position to the outwardly open position only upon the application of a preselected force on the container to create an associated predetermined threshold pressure within the container; and said valve is configured such that the predetermined threshold pressure is greater than the maximum hydraulic head pressure of the fluid product in the container when the discharge opening is oriented downwardly.

36. A self-sealing valve as set forth in claim 35, wherein:

said slit has opposite ends thereof positioned within said groove to control the opening and closing of said orifice.

37. A self-sealing valve as set forth in claim 36, wherein:

said slit has a linear shape, and is positioned centrally within said center valve area.

* * * * *